US011167580B2

(12) United States Patent
Jolic et al.

(10) Patent No.: US 11,167,580 B2
(45) Date of Patent: Nov. 9, 2021

(54) METHOD OF PRODUCING MICRO-IMAGE ELEMENTS ON A SUBSTRATE

(71) Applicant: CCL Secure Pty Ltd, Craigieburn (AU)

(72) Inventors: Karlo Ivan Jolic, Craigieburn (AU); Gary Fairless Power, Craigieburn (AU)

(73) Assignee: CCL Secure Pty Ltd, Craigieburn (AU)

( * ) Notice: Subject to any disclaimer, the term of this patent is extended or adjusted under 35 U.S.C. 154(b) by 0 days.

(21) Appl. No.: 16/728,914

(22) Filed: Dec. 27, 2019

(65) Prior Publication Data

US 2020/0130397 A1 Apr. 30, 2020

Related U.S. Application Data

(63) Continuation of application No. PCT/AU2018/050670, filed on Jun. 29, 2018.

(30) Foreign Application Priority Data

Jun. 30, 2017 (AU) ..... 2017902534

(51) Int. Cl.
*B42D 25/324* (2014.01)
*B42D 25/425* (2014.01)
*B41M 3/14* (2006.01)

(52) U.S. Cl.
CPC ..... *B42D 25/324* (2014.10); *B41M 3/142* (2013.01); *B42D 25/425* (2014.10)

(58) Field of Classification Search
CPC ..... B42D 25/324; B42D 25/425; B41M 3/142
See application file for complete search history.

(56) References Cited

U.S. PATENT DOCUMENTS

| | | | | |
|---|---|---|---|---|
| 5,712,731 | A | 1/1998 | Drinkwater et al. | |
| 2011/0045248 | A1* | 2/2011 | Hoffmuller | B42D 25/342 428/156 |
| 2013/0063826 | A1* | 3/2013 | Hoffmuller | B42D 25/425 359/619 |
| 2014/0042738 | A1* | 2/2014 | Power | B42D 25/391 283/85 |
| 2017/0023711 | A1 | 1/2017 | Jiang et al. | |

FOREIGN PATENT DOCUMENTS

| | | |
|---|---|---|
| WO | WO 2008/008635 A2 | 1/2008 |
| WO | WO 2012/126048 A1 | 9/2012 |
| WO | WO 2014/124718 A1 | 8/2014 |

OTHER PUBLICATIONS

PCT International Search Report and Written Opinion, PCT Application No. PCT/AU2018/050670, dated Sep. 10, 2018, 13 pages.

* cited by examiner

*Primary Examiner* — Kelly M Gambetta
(74) *Attorney, Agent, or Firm* — Fenwick & West LLP

(57) ABSTRACT

Embodiments relate to producing micro-image elements on a substrate for a security document, the method comprising: producing a plurality of microstructure units comprising three-dimensionally structured formations in a clear or pale relief layer on the substrate; and applying a coloured ink fluid to the relief layer, wherein the coloured ink fluid accumulates preferentially in regions of high surface curvature on each microstructure unit to provide contrasting areas of different ink density.

15 Claims, 5 Drawing Sheets

METHOD OF PRODUCING MICRO-IMAGE ELEMENTS ON A SUBSTRATE

CROSS-REFERENCE TO RELATED APPLICATIONS

This application is a bypass continuation application of International Patent Application No. PCT/AU2018/050670 filed on Jun. 29, 2018, which claims priority to Australian Patent Application No. 2017902534 filed on Jun. 30, 2017, which are incorporated by reference herein in their entirety.

TECHNICAL FIELD

The present invention relates to methods of producing micro-image elements on a substrate for a security document, and to micro-optic devices on a substrate comprising such micro-image elements. In particular, the methods include producing microstructure units comprising three-dimensionally structured formations in a clear or pale relief layer on a substrate, applying a coloured ink fluid to the relief layer, and allowing the coloured ink fluid to accumulate preferentially in regions of high surface curvature on each microstructure unit to provide contrasting areas of different ink density.

BACKGROUND OF INVENTION

It is important that security documents such as bank notes, credit cards, ID documents (including passports), land title, share and educational certificates, packaging materials for high-value goods, security labels and security cards should be difficult to replicate by counterfeiters and be provided with features allowing their authentication.

A number of different strategies have been disclosed for securing and authenticating such security documents. The use of polymeric films as substrates offers an inherent advantage, due to the greater difficulty in copying and printing on such temperature-sensitive materials and due to the amenability to incorporating a variety of visible and hidden security features.

One type of security feature which has been proposed for use in security documents is disclosed in U.S. Pat. No. 5,712,731. This security feature involves a combination of micro-lenses and micro-images for generating optically variable effects. The micro-images are formed by printing on a surface of a substrate and the micro-lenses can be formed as a separate component or on a transparent plastics sheet bonded to the micro-images. A slight mismatch between the pitch or rotational alignment of the micro-images and micro-lenses can produce optically variable effects, such as a magnified image (known as a moiré magnifier, as described in M. Hutley et al, "The moiré magnifier", Pure and Applied Optics 1994 vol. 3, pp 133-142). These security features may produce images which appear to move and/or float below or above the plane of the substrate as the observing angle changes.

However, the resolution and size of the micro-images that can be produced by the methods of U.S. Pat. No. 5,712,731 is limited by the reliance on traditional printing methods such as gravure, flexographic and intaglio printing. Typically, such printing methods cannot be used to produce images requiring a resolution of less than approximately 50 microns.

In particular, roll-to-roll gravure printing of high resolution features is limited by phenomena known in the printing industry as dot skip, drying-in, feathering and screening.

Such phenomena result in defects in printed images, in the form of small missing portions which may be random in their position. When viewed through an array of micro-lenses, the defects are magnified, producing images that are perceived by the user to have poor quality. The magnified images may have a grainy appearance, appearing to have "rashes" or "streaks" of missing dots. This particularly limits the usefulness of the security features in thin, flexible security documents, such as banknotes or the like. Apart from aesthetic considerations, poor or inconsistent quality of security features in bank notes may allow counterfeiters the opportunity to pass off poor quality reproductions as genuine bank notes.

Embossing and related techniques have previously been used to produce security features with higher resolutions than can be achieved by conventional printing techniques. Typically, a radiation-curable lacquer coating is embossed with an embossing shim and simultaneously cured to produce a micro-structured layer on the security document substrate. The micro-structured coatings may be designed to produce a number of optical effects, including diffractive and holographic effects. However, the colour contrast of such three-dimensional micro-images formed in a monochromatic coating may be unsatisfactory.

Embossing techniques have also been used to produce micro-images which create optical effects when viewed through an array of micro-lenses. Diffractive structures have been formed in an image layer on a substrate by embossing shallow grated formations into a monochromatic UV-curable coating. Contrast in the magnified image viewed through the micro-lenses is thus created by the diffractive properties of the grated microstructures set against the non-diffractive background regions of the embossed image layer. A multi-coloured magnified image is thus observed by a viewer. However, the magnified image must generally be viewed with point source lighting rather than diffuse lighting due to the diffractive nature of the image elements.

More complex techniques have been reported for producing high resolution micro-images with better colour contrast and which may be viewed in a wide range of lighting conditions. For example, a pigmented UV-curable ink may be applied directly to an embossing roller engraved with a three-dimensional microstructure. Excess ink is wiped off the roller, leaving ink retained only in the recessed regions of the engraved roller surface, and the ink is partially cured on the roller with UV-radiation. The partially cured ink microstructures are then transferred to the substrate surface and fully cured on the surface. This technique, while useful for producing high resolution, colour-contrasted micro-images for certain niche applications, is nevertheless difficult to scale up for high throughput production. Furthermore this multi-step approach suffers from a number of further disadvantages, including the inherent process complexity, the rapid wear imposed on the engraved roller due to ink application and wiping, the impacts on ink adhesion to the substrate due to the pigmentation and pre-curing, and the limitation to a single colour choice per printing unit.

There is therefore an ongoing need for new methods of producing high resolution, colour-contrasted micro-images on substrate surfaces, whereby one or more of the above-mentioned disadvantages are at least partially addressed.

A reference herein to a patent document or other matter which is given as prior art is not to be taken as an admission that the document or matter was known or that the information it contains was part of the common general knowledge as at the priority date of any of the claims.

SUMMARY OF THE INVENTION

In accordance with a first aspect the invention provides a method of producing micro-image elements on a substrate for a security document, the method comprising: producing a plurality of microstructure units comprising three-dimensionally structured formations in a clear or pale relief layer on the substrate; and applying a coloured ink fluid to the relief layer, wherein the coloured ink fluid accumulates preferentially in regions of high surface curvature on each microstructure unit to provide contrasting areas of different ink density.

Three-dimensional microstructures with micron scale (or even sub-micron scale) features can be accurately produced in a relief layer by embossing or related techniques. The inventors have found that a coloured ink fluid applied to a clear or pale relief layer produced in this manner will preferentially accumulate on the three-dimensional microstructures, providing excellent colour contrast between contrasting areas of different ink density. The contrasting areas of different ink density generally comprise areas of high ink density in the regions of high surface curvature on the microstructure units, and contrasting areas of low ink density on adjacent areas of the relief layer. It will be appreciated that the areas of low ink density may be either substantially free of ink, or have a sufficiently low ink density relative to the areas of high ink density that a visible contrast is perceived. Micro-image elements thus formed, which comprise at least ink accumulated in the regions of high surface curvature, may have a higher degree of resolution and reproducibility than can be produced with conventional printing techniques.

Without wishing to be limited by any theory, it is believed that the ink fluid flows over the surface of the relief layer into regions of high surface curvature on the microstructure units in order to minimise surface energy. The ink fluid distributes on the surface to establish an equilibrium between the cohesive forces holding the ink fluid together and the adhesive forces between the ink fluid and the microstructure surface. By controlling the three-dimensional configuration of the microstructure units, the ink fluid properties and the ink fluid loading, the method of the invention can be used to produce a wide variety of high resolution symbols, indicia and patterns on a substrate surface.

As used herein, a region of high surface curvature may be any surface region with sufficiently great curvature relative to nearby surface regions whereby ink fluid accumulates preferentially therein, such that contrasting areas of different ink density are created. It will be appreciated that regions of high surface curvature within which an ink fluid may preferably accumulate may include both substantially angular (i.e. <180° angles) features, such as corner regions defined by intersecting planes, and more curved features with concave surfaces, the configuration of which may in practice be influenced by the method of producing the microstructure units.

In some embodiments, a repeating array of substantially identical microstructure units is produced in the relief layer. In such embodiments, the coloured ink fluid accumulates in a substantially uniform distribution on each substantially identical microstructure unit, such that a repeating array of substantially identical micro-image elements is produced. The repeating array of micro-image elements may be configured in rows and/or columns having a pitch of less than about 100 microns, preferably less than about 70 microns.

In some embodiments, the viscosity of the coloured ink fluid is in the range of from 16 to 25 seconds (10 to 50 centipoise), preferably 16 to 18 seconds (10 to 20 centipoise), as measured using a Zahn Cup #2. The coloured ink fluid may be applied at a wet loading of about 0.5 $g/m^2$ to about 10 $g/m^2$. Application of ink fluids with viscosities and loadings in these ranges may be particularly preferred for preferentially accumulating the ink fluid on microstructure units having formation features with a resolution of between 1 and 3 microns, thus producing high resolution micro-images.

In some embodiments, the plurality of microstructure units is produced by embossing the three-dimensionally structured formations into the relief layer. In some such embodiments, the relief layer is produced by applying a clear or pale embossable coating to the substrate. The three-dimensionally structured formations are then embossed into the embossable coating. Preferably, the embossable coating is a radiation-curable coating. The three-dimensionally structured formations may then be simultaneously embossed into the embossable coating and cured with radiation, for example UV-radiation, to produce a cured coating. The embossable coating may be embossed with an embossing shim or roller.

In some embodiments, the plurality of microstructure units is produced by: filling a plurality of recesses in a surface of a printing tool with a clear or pale lacquer; and transferring the lacquer from the recesses to the substrate by contacting the surface of the printing tool with the substrate. In some such embodiments, the method further comprises increasing the viscosity of the lacquer in the recesses prior to contacting the surface of the printing tool with the substrate.

Filling the plurality of recesses may comprise applying the lacquer to the surface of the printing tool. The method may then further comprise removing excess lacquer from the surface of the printing tool outside of the recesses, for example with a wiping tool such as a blade or sponge. In this manner, substantially only the lacquer in the recesses is transferred to the substrate in the subsequent contact step, thereby providing a relief layer comprising discrete three-dimensionally structured formations of lacquer and the surrounding surface of the substrate. In these embodiments, the viscosity of the lacquer in the recesses may be increased before and/or after, but preferably before, removing the excess lacquer. In other embodiments, excess lacquer is not removed from the surface of the printing tool outside of the recesses. In this manner, lacquer may be transferred to the substrate from regions of the printing tool surface surrounding the recesses. In some such embodiments, a continuous layer of lacquer on the surface of the printing tool is transferred, thereby covering the substrate with a continuous coating of lacquer as the relief layer, the lacquer transferred from the recesses forming the three-dimensionally structured formations in the relief layer. Apart from the greater simplicity, this has the advantage that the surface of the printing tool is not subject to wear as a result of wiping.

In some embodiments, increasing the viscosity of the lacquer in the recesses prior to contacting the surface of the printing tool with the substrate comprises at least partially curing the lacquer. In this manner, the lacquer in the recesses may develop a degree of structural integrity sufficient to protect the configuration of the lacquer formations during transfer to the substrate. In some embodiments, the method further comprises at least partially curing the lacquer while contacting the surface of the printing tool with the substrate. Curing the lacquer while in contact with the substrate may improve the adhesion of the lacquer formations and/or layer to the substrate. In some embodiments, the lacquer is a radiation-curable lacquer, and the lacquer is at least partially cured by irradiating the lacquer with radiation, for example UV-radiation.

The microstructure units comprising three-dimensionally structured formations may in general have any suitable configuration which allows the ink to accumulate preferentially in regions of high surface curvature, thereby producing colour-contrasted micro-image elements. In some embodiments, the microstructure units comprise at least one formation side wall that intersects with a surrounding surface region forming part of the microstructure unit or adjacent relief layer surface. The intersection of the side wall and the surrounding surface region thus defines a region of high surface curvature, such that the coloured ink fluid will accumulate preferentially adjacent to the side wall. In some such embodiments, the surrounding surface region is oriented in substantial alignment with the plane of the relief layer. The side wall may be oriented at a steep, including substantially perpendicular, angle to the plane of the relief layer.

In some embodiments, the microstructure units comprise at least one formation in the form of a recess which is recessed into surrounding regions of the relief layer. The recess generally has side walls and a recess base surface between the side walls, although it will be appreciated that the recess may in some embodiments comprise a substantially curved surface such that the side walls and the recess base surface are not separated by angular intersections.

In some embodiments, the recess has a minimum width of between 0.5 and 10 microns, preferably between 1 and 3 microns. The minimum width of a recess is the minimum distance between opposing side walls of the recess, and thus correlates to the resolution of the microstructure units. In some embodiments, the recess is a groove formed in the surface plane of the relief layer. In such embodiments, the minimum width of the recess is the width of the groove.

In some embodiments, the coloured ink fluid, when applied to the relief layer, accumulates in regions of high surface curvature within the recess by flowing from the surrounding regions into the recess. It is believed that the flow of ink fluid into the recess minimises the surface energy because the recess includes regions of high surface curvature on the relief layer surface.

In some embodiments, the coloured ink fluid accumulates preferentially within the recess and covers the recess base surface. The recess base surface is thus entirely covered by a layer of the ink fluid, although typically the coloured ink fluid does not fill the recess. A colour contrast is thus established between the ink-covered recess of the microstructure units and the surrounding regions, which are free of, or at least depleted of, the ink fluid. In other embodiments, the coloured ink fluid accumulates preferentially within the recess in regions of high surface curvature at an intersection of the side walls and the recess base surface, wherein the contrasting areas of different ink density comprise areas of high ink density adjacent to the side walls and a contrasting area of low ink density on the recess base surface intermediate the side walls. A colour contrast is thus established by the selective distribution of the ink fluid within the recesses.

In some embodiments the microstructure units comprise at least one formation in the form of a protrusion which protrudes from surrounding regions of the relief layer. The protrusion generally has side walls, although it will be appreciated that the protrusion may in some embodiments comprise a substantially curved surface such that the side walls are not separated from the surrounding regions by angular intersections.

In some embodiments, the protrusion has a minimum width of between 0.5 and 10 microns, preferably between 1 and 3 microns. The minimum width of a protrusion is the minimum distance between opposing side walls of the protrusion, and thus correlates to the resolution of the microstructure units. In some embodiments, the protrusion is a ridge formed proud on the surface plane of the relief layer. In such embodiments, the minimum width of the protrusion is the width of the ridge.

In some embodiments, the coloured ink fluid, when applied to the relief layer, accumulates preferentially in regions of high surface curvature at an intersection of the side walls and the surrounding regions of the relief layer. Areas of high ink density are thus provided adjacent to the side walls. These areas of high ink density contrast against areas of low ink density further removed from the side walls on the surrounding regions of the relief layer and/or on the protrusion itself. It is believed that the flow of ink fluid minimises the surface energy because the intersection between the side walls and the surrounding regions constitutes a region of high surface curvature on the relief layer surface.

In some embodiments, the plurality of microstructure units comprises a contiguous network of elevated regions extending across the relief layer and connecting adjacent microstructure units. Entrapment of air bubbles in the relief layer may be avoided when embossing a plurality of microstructure units having this configuration into the relief layer.

In some embodiments, micro-image elements comprising ink accumulated in the regions of high surface curvature produce a visible optical effect when viewed through an array of focusing elements disposed on the substrate, for example on an opposite surface of the substrate to the relief layer. In some embodiments, the substrate is thus transparent. The visible optical effect may be a magnified moiré image, an integral image, a contrast switching image, an interlaced image, or a flipping image. In some embodiments, the coloured ink fluid forms a design element when directly viewed on the substrate that is distinctive from the visible optical effect.

In some embodiments, the coloured ink fluid is a solvent-based ink with solids content of between about 15% and about 25% by mass. The coloured ink fluid may be applied by Gravure printing. The method of the invention may further comprise drying or curing the coloured ink fluid.

In some embodiments, the method of the invention further comprises applying a transparent protective coating over the relief layer after applying the coloured ink fluid. In other embodiments, the method of the invention further comprises applying a contrast coating over the relief layer after applying the coloured ink fluid, wherein the contrast coating has a different colour to the coloured ink fluid such that micro-image elements comprising ink accumulated in the regions of high surface curvature are contrasted against the contrast coating when viewed in reflected light through the substrate.

In accordance with a second aspect, the invention provides micro-image elements on a substrate for a security document, produced by the method according to any of the embodiments disclosed herein.

In accordance with a third aspect the invention provides a micro-optic device on a substrate for a security document, comprising: a plurality of microstructure units comprising three-dimensionally structured formations in a clear or pale relief layer on the substrate; and a coloured ink on the relief layer, wherein the coloured ink is accumulated preferentially in regions of high surface curvature on each microstructure unit, thereby providing contrasting areas of different ink density.

The contrasting areas of different ink density generally comprise areas of high ink density in the regions of high surface curvature on the microstructure units, and contrasting areas of low ink density on adjacent areas of the relief layer.

In some embodiments of the third aspect, the relief layer comprises a coating on the substrate and the microstructure units are embossed in the coating. The relief layer may comprise a repeating array of substantially identical microstructure units, with the coloured ink being accumulated in a substantially uniform distribution on each substantially identical microstructure unit.

The micro-optic device may further comprise an array of focusing elements disposed on the substrate, wherein micro-image elements comprising the coloured ink accumulated in the regions of high surface curvature produce a visible optical effect when viewed through the array of focusing elements.

Where the terms "comprise", "comprises" and "comprising" are used in the specification (including the claims) they are to be interpreted as specifying the stated features, integers, steps or components, but not precluding the presence of one or more other features, integers, steps or components, or group thereof.

Further aspects of the invention appear below in the detailed description of the invention.

BRIEF DESCRIPTION OF DRAWINGS

Embodiments of the invention will herein be illustrated by way of example only with reference to the accompanying drawings in which.

DETAILED DESCRIPTION

Figure 1:
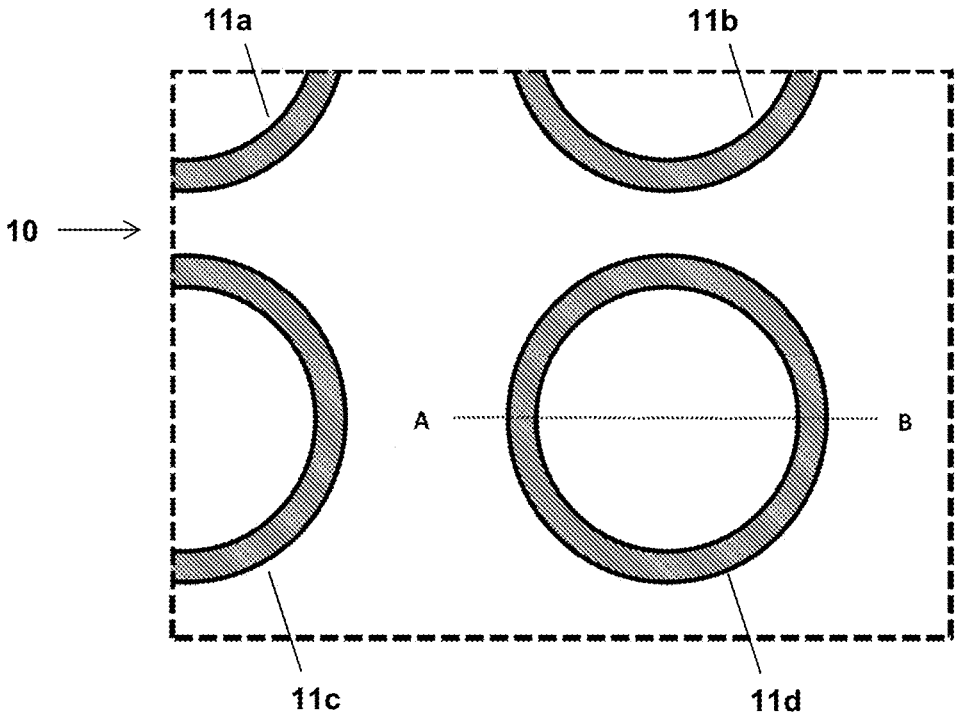
FIG. 1 depicts in plan view a cut-out section of a relief layer with microstructure units comprising recessed three-dimensionally structured formations, produced in accordance with an embodiment of the invention.

The present invention relates to a method of producing micro-image elements on a substrate for a security document. The method includes producing a plurality of microstructure units comprising three-dimensionally structured formations in a clear or pale relief layer on the substrate. A coloured ink fluid is then applied to the relief layer, so that the coloured ink fluid accumulates preferentially in regions of high surface curvature on each microstructure unit to provide contrasting areas of different ink density.

Substrate

The substrate may be any suitable substrate for security documents. The substrate may be paper or other fibrous material such as cellulose; a plastic or polymeric material including but not limited to polypropylene (PP), polyethylene (PE), polycarbonate (PC), polyvinyl chloride (PVC), polyethylene terephthalate (PET); or a composite material of two or more materials, such as a laminate of paper and at least one plastic material, or of two or more polymeric materials. The use of plastic or polymeric materials in the manufacture of security documents pioneered in Australia has been very successful because polymeric banknotes are more durable than their paper counterparts and can also incorporate new security features (such as micro-optic devices).

In preferred embodiments, the substrate is a transparent or translucent material. Transparent substrates are particularly preferred as micro-image elements produced on one surface of the substrate may then be viewed through an array of focusing elements disposed on the opposite surface of the substrate. The thickness of the transparent substrate is preferably above 50 microns, to allow the micro-image elements to be placed at, or just within, the focal length of focusing elements on the opposite surface. In some embodiments, the substrate is from 60 to 100 microns thick, preferably from 65 to 90 microns thick.

A particularly suitable transparent substrate is polypropylene and in particular bi-axially oriented polypropylene.

One common security feature in polymeric banknotes produced for Australia and other countries is a transparent area or "window". In one embodiment, the micro-image elements of the invention are produced on a window region of a transparent substrate. The substrate may then include one or more opacifying layers over other regions of the substrate surface. Alternatively, the transparent substrate may be an insert into a cut-out region of a substantially opaque material, such as paper or fibrous material.

Producing Microstructure Units in a Clear or Pale Relief Layer

The invention includes a step of producing a plurality of microstructure units comprising three-dimensionally structured formations in a clear or pale relief layer on the substrate. The relief layer is preferably transparent or translucent. Transparent relief layers are particularly preferred, as these allow the subsequently applied coloured ink fluid to be viewed in high contrast against a clear background. Moreover, in embodiments where the colour-contrasted micro-image elements on one side of a substrate are to be viewed through focusing elements disposed on the opposite side of the substrate, a sufficient degree of transparency of the relief layer (and the substrate) is required to ensure that the micro-image elements may be viewed.

The relief layer is preferably colourless, thereby providing a high contrast for the coloured ink fluid. However, it is not excluded that the relief layer may have a pale colouration, provided that the subsequently applied ink fluid has a sufficient contrast to adequately define colour-contrasted micro-image elements against the background colouration of the coating.

The plurality of microstructure units may be produced by embossing the three-dimensionally structured formations into the relief layer. The microstructure units may be embossed directly into the substrate to form the relief layer as a structured surface layer of the substrate itself, for example by hot-embossing a suitable polymeric substrate. More typically, however, the relief layer comprises a clear or pale coating applied to the substrate, with the microstructure units comprising the three-dimensionally structured formations being embossed into the coating. For example, the plurality of microstructure units may be hot-embossed into a thermoplastic coating applied to the substrate.

In a preferred embodiment, the clear or pale coating is a radiation-curable coating. The radiation-curable coating may be any lacquer or other coating which may be applied to the surface of the substrate, and which can then be embossed while soft to form microstructure units having three-dimensionally structured formations, and cured with radiation to harden the embossed microstructure units. The radiation-curable coating is preferably curable by ultraviolet (UV) radiation. Alternatively, the radiation-curable coating may be curable by other forms of radiation, such as electron beams or X-rays.

In one particularly preferred embodiment, the clear or pale radiation-curable coating comprises an acrylic based UV-curable clear embossable lacquer. Such UV curable lacquers can be obtained from various manufacturers, including Kingfisher Ink Limited, product ultraviolet type UVF-203 or similar. These coatings have been reported to be particularly suitable for embossing microstructures, including diffractive structures such as DOEs, diffraction gratings and holograms, microlenses and lens arrays, and non-diffractive optically variable devices. Alternatively, the radiation curable embossable coatings may be based on other compounds, e.g. nitro-cellulose.

In some embodiments, the clear or pale radiation-curable coating, when applied to the substrate, has a viscosity falling in the range of from about 20 to about 175 centipoise, and more preferably from about 30 to about 150 centipoise. The viscosity may be determined by measuring the time to drain the lacquer from a Zahn Cup #2. A sample which drains in 20 seconds has a viscosity of 30 centipoise, and a sample which drains in 63 seconds has a viscosity of 150 centipoise. Viscosities in this range may allow the coating to be applied and embossed by Gravure printing techniques.

The radiation-curable coating may be applied to the substrate in a Gravure printing process, and then embossed in a second step. In some embodiments, the coating is embossed with an embossing shim or roller having a three-dimensionally structured surface corresponding to the configuration of the relief layer to be embossed. A shim, as is known in the industry, is, typically, a thin piece of metal which has been formed, using electroplating processes or similar, from structures created using photolithography techniques or the like. A roller can be formed from similar techniques, but, more commonly is formed from etching, engraving or laser ablating techniques.

Curing of the coating generally does not commence before the radiation-curable coating is embossed, but it is possible for the curing step to take place either after embossing or at substantially the same time as the embossing step. Preferably, the radiation-curable coating is embossed and simultaneously cured by ultraviolet (UV) radiation. In such embodiments, the coating may be irradiated with UV light through the substrate (if suitably transparent) or through a transparent embossing tool.

Although the invention is described herein with particular reference to embossed microstructure units, it will be appreciated that the principles of the invention may also be applied with microstructure units produced in a relief layer by other techniques. In one such alternative approach, the microstructure units are produced by directly applying pre-shaped three-dimensional formations onto the substrate, for example as described in WO2011/102800.

Thus, in some embodiments, recesses of appropriate configuration in the surface of a printing tool are filled with a clear or pale lacquer. The printing tool may be, for example, an engraved, etched or laser-ablated roller. Suitable lacquers include, but are not limited to, the radiation-curable coatings described herein in relation to embodiments where the microstructure units are embossed into a coating on the substrate. The viscosity of the lacquer is suitable to fill at least the recesses on the printing tool surface, and optionally also to provide a layer of substantially uniform thickness over the surface of the tool. After application, the viscosity of the lacquer in at least the recesses is increased, The viscosity of the lacquer may be increased by any suitable means, typically by at least partially curing the lacquer, so as to provide sufficient structural integrity to the shaped lacquer during the subsequent transfer. The lacquer may be partially cured by irradiating the lacquer on the printing tool surface with UV-radiation.

Optionally, excess lacquer is removed from the surface of the printing tool outside of the recesses, for example with a wiping tool such as a sponge or blade, such that only lacquer within the recesses is transferred to the substrate in the subsequent contact step. Alternatively, a layer of lacquer covering an extended section of the printing tool surface, including the recesses, may be provided and viscosified, such that the entire layer, including the recess-shaped formations, is transferred to the substrate in the subsequent contact step.

The lacquer is transferred from the recesses, and optionally also surrounding lacquer-coated areas of the printing tool, to the substrate by contacting the surface of the printing tool with the substrate. Where the printing tool is a roller, the roller and the substrate may be brought into rolling contact. The lacquer may be at least partially cured while contacting the surface of the printing tool with the substrate, so as to adhere the lacquer to the substrate. Where a radiation-curable lacquer is used, for example, the lacquer may be cured by irradiating the lacquer with UV-radiation through a transparent substrate and/or through the printing tool surface. The printing tool is then removed, leaving the three-dimensionally structured formations of cured lacquer in a relief layer on the substrate surface. Optionally, the lacquer may be further cured after removal of the printing tool.

With some polymeric substrates, it may be necessary or desirable to apply an intermediate layer to the substrate before the radiation-curable coating or the shaped lacquer formations are applied, to improve the adhesion of the coating or lacquer to the substrate. The intermediate layer preferably comprises a primer layer, and more preferably the primer layer includes a polyethylene imine. The primer layer may also include a cross-linker, for example a multi-functional isocyanate. Examples of other primers suitable for use include: hydroxyl terminated polymers; hydroxyl terminated polyester based co-polymers; cross-linked or uncross-linked hydroxylated acrylates; polyurethanes; and UV curing anionic or cationic acrylates. Examples of suitable cross-linkers include: isocyanates; polyaziridines; zirconium complexes; aluminium acetylacetone; melamines; and carbodiimides. The type of primer may vary for different substrates and radiation-curable coating. Preferably, a primer is selected which does not substantially affect the optical properties of the embossed coating or applied lacquer formations.

Plurality of Microstructure Units

In the method of the invention, a plurality of microstructure units comprising three-dimensionally structured formations is produced in the clear or pale relief layer on the substrate. The microstructure units may be non-identical or substantially identical, and the microstructure units may be arranged as an ordered (such as a uniformly repeating) pattern of microstructure units or a non-ordered arrangement. The preferred configuration of both the microstructure units themselves and their relative positioning on the relief layer will depend on the visual effect intended to be created by the colour-contrasted micro-image elements subsequently produced via application of a coloured ink fluid to the microstructures. In some embodiments, the microstructure units may have at least one dimension in the plane of the relief layer of less than about 100 microns, preferably less than about 70 microns, more preferably less than about 50 microns. In some embodiments, the microstructure units may be configured in rows and/or columns on the relief layer having a pitch of less than about 100 microns, preferably less than about 70 microns. In some embodiments, the relief layer comprises a repeating array of substantially identical microstructure units. The repeating array of substantially identical microstructure units may be configured in rows and/or columns.

The three-dimensional configuration of the microstructure units produced in the relief layer is selected such that the subsequently applied coloured ink fluid preferentially accumulates on the surface thereof to produce colour-contrasted micro-image elements with the intended dimensions and resolution on the surface of the substrate. Therefore, any configuration that may be produced in a relief layer, such as by embossing, and which can act as a three-dimensional template allowing flow and accumulation of a subsequently applied ink fluid, is considered to fall within the scope of the invention. However, the microstructure units generally do not include diffractive structures, since the visualisation of the micro-image elements formed by the ink fluid accumulation on the microstructure units does not rely on a contrast between diffractive and non-diffractive regions of the relief layer.

The microstructure units may thus include any suitable formation features three-dimensionally produced in the relief layer. Suitable features may include geometrical shapes such as squares, rectangles or circles, or discrete pictures. The microstructure units may comprise lines formed as recessed grooves or protruding ridges formed in the relief layer. The lines may define individually coherent symbols or indicia, such as letters or numerals. Alternatively, they may define patterns, such as repeating patterns. In some embodiments, the microstructure units are unit cells of a larger repeating pattern that extends two-dimensionally over the relief layer.

The microstructure units may include formation features that are identifiably recessed into or protruding from surrounding regions of the relief layer. For example, the microstructure units may comprise one or more recesses which are recessed into the base surface plane of the relief layer or one or more protrusions which protrude from the base surface plane of the relief layer. It is envisaged that the microstructure units may comprise both recesses and protrusions in the base surface plane of the relief layer. As used herein, the base surface plane of a relief layer is the substantially planar surface of the relief layer defined by regions without three-dimensionally structured formations. The recesses and protrusions generally have formation side walls, which may in some embodiments be steeply inclined, including substantially perpendicular, relative to the surrounding regions and/or the base surface plane of the relief layer.

While a number of embodiments are described herein with reference to formation features such as "recesses", "protrusions", "side walls" etc, the skilled person will appreciate that these terms are idealised representations, and that more complex microstructure units may also be produced in accordance with the invention in which individual formation features cannot be readily identified as being either recesses or protrusions, or in which a base surface plane of the coating is not readily defined.

The method of the invention is particularly useful for, but not limited to, the production of micro-image elements having finely resolved features that are too small to be produced by conventional printing techniques. In some embodiments, therefore, the microstructure units have three-dimensionally structured formation features, such as recessed grooves or protruding ridges, with a width of less than 50 microns, preferably less than 10 microns, most preferably less than 5 microns, such as between 1 and 3 microns.

The microstructure units may have a depth of less than 5 microns, preferably less than 3 microns. The inventors have found that depths of about 2 microns are sufficient to allow preferential ink accumulation on three-dimensionally structured relief layers, such that micro-image elements with satisfactory colour contrast and high resolution are produced.

Recessed formation features may be formed in the relief layer by embossing an embossable coating with a shim or roller having corresponding protruding embossing elements, while protruding formation features may be formed by embossing with a shim or roller having corresponding recessed embossing elements, which fill with the embossable coating composition during the embossing step. An important consideration when embossing and curing a coating is the exclusion of air bubbles, which can impair the appearance of the micro-image elements and any resulting visual optical effects created thereby. In some embodiments, the configuration of the embossing tool may therefore be designed to minimise the risk of entrapping air bubbles in the cured embossed coating.

For example, where the embossing surface of a shim (or roller) has enclosed areas which isolate portions of a coating during embossing (whether as recessed shapes in the base shim surface, or as portions of the base shim surface isolated within closed protruding features such as an "O"-shaped ridge), the likelihood of entrapping air bubbles in a coating embossed with the shim will increase. It may therefore be preferred that any recessed areas within the shim form a contiguous network which allows air bubbles to escape during the embossing step. This will in turn affect the configuration of the plurality of microstructure units produced with the shim. Therefore, in some embodiments, the plurality of microstructure units comprises a contiguous network of elevated regions extending across the relief layer and connecting adjacent microstructure units. The contiguous network of elevated regions may be formed in the base surface plane of the coating when the microstructure units comprise recessed features. Alternatively, the contiguous network of elevated regions may be formed as a network of embossed protrusions, such as ridges, formed proud on the base surface plane of the coating.

Application and Accumulation of Coloured Ink Fluid on the Microstructure Units

After the plurality of microstructure units has been produced, a coloured ink fluid is applied to the relief layer. In the method of the invention, the plurality of colour-contrasted micro-image elements is provided by preferential accumulation of the ink fluid on the three-dimensionally structured surface of the microstructure units. The inventors have discovered that small (such as micron-scale) micro-images with excellent resolution and colour contrast may be produced using this approach.

Without wishing to be bound by any theory, it is believed that the ink fluid accumulates on the relief layer surface so as to minimise its surface energy. The imperative to minimise surface energy causes the ink fluid to flow over the three-dimensional surface of the microstructure units and to accumulate in a predictable distribution that is not primarily governed by the method of application or by gravitational forces. Rather, it is believed that the ink fluid accumulates so as to establish an equilibrium between the cohesive forces holding the fluid together and the adhesive forces between the fluid and the microstructure surface.

The composition of the relief layer and the ink fluid may thus be selected such that adhesive forces are appropriately balanced relative to the cohesive forces, i.e. the relief layer is suitably wettable by the ink fluid. The wettability should be sufficiently high to induce the ink fluid to flow into regions of high surface curvature on the surface of the microstructure units, but not so high as to induce the ink fluid to cover the entire surface of the relief layer.

The coloured ink fluid should have a suitable viscosity to allow preferential accumulation on the microstructure units. An ink fluid with an unacceptably high viscosity will not be able to flow on the three-dimensional relief layer surface, while an ink fluid with an unacceptably low viscosity may flow too freely to provide precise control of ink distribution. The skilled person, with the benefit of this disclosure, will appreciate that the optimum viscosity for a particular application will depend on an appropriate balance between these competing imperatives, considered together with other factors, including the size and configuration of the three-dimensional formation features of the microstructure units and the intended visual effect. In some embodiments, the viscosity of the coloured ink fluid is in the range of from 16 to 25 seconds (10 to 50 centipoise), preferably 16 to 18 seconds (10 to 20 centipoise), as measured using a Zahn Cup #2. Ink fluids with this viscosity have been found to produce high resolution micro-images by preferential accumulation on microstructure units having formation features with a resolution of between 1 and 3 microns and a depth of about 2 microns.

The ink fluid is applied at a suitable mass loading such that accumulation on the microstructure units provides the desired micro-image elements. If the ink fluid is applied at too high a mass loading, the distribution of ink fluid on the three-dimensional microstructures will not produce a satisfactory colour contrast between areas of different ink density. In the extreme case, the ink fluid will cover the entire surface of the relief layer with a layer of sufficient consistency that no colour contrast is obtained. If the ink fluid loading is too low, regions of the three-dimensional microstructures intended to be covered by ink fluid will remain uncovered, so that the micro-image elements are not satisfactorily produced. The skilled person, with the benefit of this disclosure, will appreciate that the optimum ink fluid loading for a particular application will depend on a number of factors, including the three-dimensional configuration of the microstructure units, the ink fluid viscosity, and the intended visual effect. In some embodiments, the coloured ink fluid is applied at a wet loading in the range of from about 0.5 $g/m^2$ to about 10 $g/m^2$.

In some embodiments, the coloured ink fluid may be a solvent based ink, with solids content that ranges from about 10% up to about 60% by mass, for example between about 15% and about 25% by mass. The preferred solids content may be selected at least in part to impart a suitable viscosity to the ink fluid.

The coloured ink fluid may be applied to the relief layer by any suitable technique, for example by roll-to-roll Gravure printing. Gravure or other conventional printing techniques are suitable for producing the micro-image elements of the present invention, despite the resolution limitations of these techniques, because the production of the colour-contrasted micro-image elements relies on the preferential accumulation of the ink fluid on the three-dimensionally structured surfaces of the microstructure units governed by surface energy considerations, and not on precision placement of ink on the surface of the relief layer.

The coloured ink fluid may be of any suitable colour able to produce a satisfactory colour contrast against the relief layer, including black and white inks. In some embodiments, a single coloured ink fluid is applied to the relief layer. In other embodiments, two or more different coloured inks fluids are applied. The differently coloured ink fluids may be applied to different sections of the relief layer, such that each microstructure unit on the relief layer receives only a single coloured ink fluid. However, it is not excluded that differently coloured ink fluids might be applied to the same section of the relief layer, for example in sequential application steps, so that regions of composite colours are formed.

Optionally, the coloured ink fluid applied to the relief layer forms a separate design element that does not rely for its visual impact on the preferential accumulation of the ink fluid on each microstructure unit. Such a design element, for example one or more coloured regions on the surface, generally extends over the plurality of microstructure units, or a substantial portion thereof, and is thus not constrained by the resolution challenges of traditional ink application methods. The optional design element, when directly viewed on the surface of the substrate, may be distinctive from any visible optical effect produced by the colour-contrasted micro-image elements when viewed through an array of focusing elements disposed on the opposite surface of the substrate.

It will be appreciated that the distribution of the ink fluid in the contrasting areas of different ink density (such as areas of high ink density contrasting with areas of low or substantially zero ink density), and thus the shapes and/or contrast of the micro-image elements, depends on the three-dimensional configuration of the microstructure units. In some embodiments, the ink fluid preferentially accumulates in regions of high surface curvature adjacent to one or more sidewalls of the microstructure units, i.e. at the intersection between the side walls and surrounding surface regions. For recessed microstructure unit formation features, the ink fluid may thus accumulate at the corners (either substantially angular or more curved) where the side walls and the base of the recess intersect, or in the entire recess, thereby at least partially filling it. For protruding microstructure unit formation features, the ink fluid may accumulate at the corners (either substantially angular or more curved) where the side walls and the base surface plane of the relief layer intersect.

In some embodiments, the ink fluid accumulates only in selected areas of the three-dimensional microstructures, while other areas of the microstructures and/or surrounding areas of the relief layer are substantially free of ink fluid. However, it is not excluded that ink fluid may cover the entire surface of the three-dimensional microstructures, or even the entire relief layer, provided that sufficiently selective accumulation of ink fluid occurs to produce a satisfactory colour contrast between the contrasting areas of different ink density.

In embodiments where the relief layer comprises a repeating array of substantially identical microstructure units, the coloured ink fluid may accumulate in a substantially uniform distribution at each microstructure unit in the array, particularly if the ink fluid is applied at a consistent loading over the relief layer. This allows for the creation of a repeating array of substantially identical colour-contrasted micro-image elements on the surface of the substrate. A number of visual optical effects, including magnified moiré images, require such an ordered array of identical images to produce the desired effect.

In some embodiments, the microstructure units comprise at least one recess which is recessed into surrounding regions of the relief layer. When applied to the relief layer, the coloured ink fluid may flow from the surrounding regions into the recess, thus providing a colour contrast between the ink accumulated in at least a portion of the recess and the ink-depleted surrounding regions. It is believed that the flow of ink fluid into the recess minimises the surface energy of the system because the recess includes regions of high surface curvature on the relief layer surface. For example, the entire interior surface of the recess (including the side walls) may be concave. As another example, the side walls may be relatively planar, but are steeply inclined relative to a base surface of the recess so as to provide a region of high surface curvature along the intersection (corner region) between the side walls and the base surface of the recess.

In some embodiments, the coloured ink fluid preferentially accumulates so as to cover the base surface of the recess between the side walls with a layer of the ink fluid. The micro-image elements are thus formed by the colour contrast between the area of high ink density where the ink fluid fills the recess and the area of low ink density defined by the surrounding regions of the relief layer, which are free of or depleted of the ink fluid. For example, where the recess is a groove recessed into the relief layer, the ink fluid preferentially accumulated in the recess will appear as a coloured line on the clear relief layer, having the thickness of the groove. In such embodiments, it is not required that the recess is entirely filled with ink fluid to create a satisfactory colour contrast, and it is generally preferred that the recess is not completely filled as this is likely to lead to poor contrast as a result of ink accumulating both in the recess and on the surrounding regions.

In some embodiments, the coloured ink fluid accumulates within the recess in regions of high surface curvature at the intersection of the side walls and the recess base surface. In such embodiments, the ink fluid accumulates selectively against at least one side wall of the recess, and preferably accumulates selectively against two opposing side walls of the recess. The ink fluid may accumulate preferentially only along the corners where the side walls and the base surface of the recess intersect, leaving an intermediate portion of the base surface of the recess as a contrasting area of low ink density. The micro-image elements of these embodiments are formed at least in part by the colour contrast created by the selective distribution of ink within the recess. For example, where the recess is a groove recessed into the relief layer, the preferentially accumulated ink fluid in the recess may form a pair of lines of ink against the opposing side walls of the groove.

It will be appreciated that the loading of ink fluid is one important factor which may determine whether the ink fluid preferentially accumulates by at least partially filling a recessed feature, or by selectively accumulating only in selected regions of high surface curvature within the recesses, such as against the side walls. However, other factors such as the viscosity of the ink fluid, the coating wettability and the dimensions (such as width) of the recessed feature may also play a role in determining the ink fluid distribution at a given loading.

In some embodiments, the microstructure units comprise at least one protrusion which protrudes from surrounding regions of the relief layer. When applied to the relief layer, the coloured ink fluid may flow from the surrounding regions and preferentially accumulate in a region of high surface curvature at the intersection of at least one side wall of the protrusions and the surrounding regions of the relief layer, and preferably against both opposing side walls. It is believed that the flow of ink fluid minimises the surface energy of the system because the intersection between the side walls of the protrusions and the surrounding regions constitutes a region of high surface curvature on the relief layer surface. The ink fluid may thus accumulate preferentially in areas of high ink density along the corners where the side walls and the base surface plane of the relief layer intersect, leaving other regions of the base surface plane and the upper portions of the protrusion free of or depleted of the ink fluid. The micro-image elements are thus formed by the colour contrast created by the selective accumulation of ink outlining the protrusions. For example, where the protrusion is a ridge formed proud on the relief layer, the ink fluid may form a pair of lines of ink preferentially accumulated against the opposing side walls of the ridge.

Additional Features

Once the coloured ink fluid has preferentially accumulated on the microstructure units, the ink fluid may be dried and/or cured. Drying or curing the ink may prevent further ink flows, permanently fixing and adhering the ink to the relief layer and thus preserving the appearance of the micro-image elements. For example, where the ink fluid is a solvent based ink, a drying step may be performed with heater ovens that blow warm air onto the substrate.

In some embodiments, a transparent protective layer is applied over the relief layer after the coloured ink fluid has been applied and preferentially accumulated (and optionally dried or cured). The transparent protective coating may be a solvent based ink applied via gravure printing to fill the three-dimensionally structured relief layer and provide a smooth and planar surface. The transparent protective layer may then be dried using heater ovens that blow warm air onto the substrate. The transparent protective coating may provide protection against both physical damage due to wear and against counterfeiting by mechanical lifting.

In other embodiments, the method of the invention further comprises applying a contrast coating over the relief layer after the coloured ink fluid has been applied and preferentially accumulated (and optionally dried or cured). The contrast coating should have a different colour to the coloured ink fluid such that the micro-image elements are contrasted against the contrast coating when viewed in reflected light through the substrate.

In some embodiments, the colour-contrasted micro-image elements produced by the methods of the invention are capable of producing a visible optical effect, such as a magnified image, when viewed through an array of focusing elements disposed on the substrate. The magnified image may best be viewed in reflected light to obtain bright colouration corresponding to the colour of first ink fluid. However the magnified image may also be viewed in transmitted light, appearing in colour if the ink fluid is sufficiently translucent, or appearing in black and white if the ink fluid is substantially opaque. As used herein, "transmitted light" means light transmitted through the substrate from a source on the opposite side of the substrate from the viewer, and "reflected light" means light originating from a source on the same side of the substrate as the viewer and reflected back to the viewer by the micro-image elements. Advantageously, the magnified images produced when viewing the micro-image elements through an array of focusing elements have satisfactory contrast in a wide range of lighting conditions (including diffuse lighting), since the micro-image elements rely on colour contrast rather than diffractive effects.

The visible optical effect produced when viewing the micro-image elements may include a magnified moiré image, an integral image, a contrast switching image, an interlaced image, or a flipping image. Because of the high resolution and complex micro-image elements that may be produced on a substrate surface with the method of the invention, a wide variety of optical effects may be created. Preferably, the visual optical effect is a magnified moiré image or integral image, more preferably a magnified moiré image.

The extremely fine resolution of the colour contrasted micro-image elements that can be produced in accordance with the invention is particularly advantageous for producing magnified optical effects. For example, micro-image elements intended for imaging as a magnified moiré image effect through a 2-D array of micro-lenses must be configured as an array of image "icons" that are roughly equal in size to one micro-lens. Therefore, the finer the resolution of the features in the icons, the greater the complexity of the magnified image that can be produced.

Micro-Optic Devices and Security Features

The present invention also relates to a micro-optic device on a substrate for a security document. The micro-optic device comprises a plurality of microstructure units comprising three-dimensionally structured formations in a clear or pale relief layer on the substrate. The micro-optic device further comprises a coloured ink on the relief layer, wherein the coloured ink is preferentially accumulated in regions of high surface curvature on each microstructure unit. Contrasting areas of different ink density are thus provided. The contrasting areas, typically including areas of high ink density and contrasting areas of low (including substantially zero) ink density, form at least in part the plurality of colour-contrasted micro-image elements on the substrate.

The micro-optic device may be produced by any of the methods described herein. In this regard, the substrate, the composition of the relief layer, the plurality of microstructure units produced thereon, and the plurality of colour-contrasted micro-image elements may be the same as described in relation to any of the method embodiments disclosed herein. The coloured ink accumulated in regions of high surface curvature on the microstructure units may be so placed by applying a coloured ink fluid to the relief layer, allowing the coloured ink fluid to preferentially accumulate on the microstructure units and optionally drying or curing the coloured ink fluid, as described herein.

In some embodiments, the relief layer comprises a coating on the substrate and the three-dimensionally structured formations of the microstructure units are embossed into the coating. The coating may be a cured coating, for example a radiation cured coating such as a UV-cured coating. In other embodiments, the relief layer comprises three-dimensionally structured formations formed as discrete pre-shaped lacquer structures (or pre-shaped coating layers) transferred to the substrate from the surface of a printing tool, as described herein.

In some embodiments, the relief layer of the micro-optic device comprises a repeating array of substantially identical microstructure units, and the coloured ink is accumulated in a substantially uniform distribution on each substantially identical microstructure unit. A repeating array of substantially identical colour-contrasted micro-image elements is thus provided on the surface of the substrate. A number of visual optical effects, including magnified moiré image, require such an ordered array of identical images to produce the desired effect.

In some embodiments, the micro-optic device further comprises an array of focusing elements disposed on the substrate. In such embodiments, the colour-contrasted micro-image elements may be configured to produce a visible optical effect, such as a magnified moiré image, an integral image, a contrast switching image, an interlaced image, or a flipping image, when viewed through the array of focusing elements. In some embodiments, the array of focusing elements is disposed on a surface of the substrate opposite to the surface of the substrate on which the relief layer is disposed. However, it is not excluded that the array of focusing elements could be disposed on top of the relief layer, optionally spaced apart by an interposed transparent layer. In such embodiments, the array of focusing elements may optionally be configured to focus on a reflection of the micro-image elements in a reflective layer disposed on the opposite surface of the substrate.

The array of focusing elements is generally disposed at a distance from the plurality of micro-image elements that is substantially equal to, or within, the focal length of the focusing elements. For use in security documents, the focal lengths of the focusing elements is preferably in the range of from 20 to 130 microns, more preferably from 65 to 90 microns, corresponding with the typical thickness of transparent substrates for security documents.

The array of focusing elements may include any devices previously reported to be suitable for viewing micro-image elements on a substrate, particularly a substrate for a security document. In some embodiments, the array of focusing elements may comprise refractive micro-lens structures, including conventional micro-lenses and Fresnel lenses. In other embodiments, diffractive focusing elements such as zone plates or photon sieves may be employed. Fresnel lenses and diffractive focusing elements may be particularly suited for integration into a micro-optic device on a security document, because such focusing elements are thinner than conventional micro-lens structures for a given focal length.

The array of focusing elements may be in register with the plurality of micro-image elements on the substrate. Alternatively, the alignment between the focusing elements and the micro-image elements may be offset so as to produce a desired visual optical effect.

The array of focusing elements may be produced as a separate sheet which is adhered to the substrate. However, in preferred embodiments, the array of focusing elements is produced by applying a transparent radiation-curable coating to the substrate, and embossing and curing the coating with radiation to form the focusing elements. The transparent coating into which the focusing elements are embossed may optionally have the same composition as the relief layer into which the microstructure units are embossed.

The micro-optic device may be formed on a substrate for any security document, including, but not limited to the following: items of currency such as banknotes and coins, credit cards, cheques, passports, identity cards, securities and share certificates, driver's licenses, deeds of title, travel documents such as airline and train tickets, entrance cards and tickets, birth, death and marriage certificates, and academic transcripts. In some embodiments the micro-optic device is formed on the substrate of banknotes or identification documents such as identity cards or passports.

The micro-optic device according to the invention may constitute, or form a component of, a security device on a security document. The security device may be provided on the security document additionally to one or more of a large number of other security devices, elements or features intended to protect a security document or token from counterfeiting, copying, alteration or tampering. Security devices may take a wide variety of forms, such as security threads embedded in layers of the security document; security inks such as fluorescent, luminescent and phosphorescent inks, metallic inks, iridescent inks, photochromic, thermochromic, hydrochromic or piezochromic inks; printed and embossed features, including relief structures; interference layers; liquid crystal devices; lenses and lenticular structures; optically variable devices (OVDs) such as diffractive devices including diffraction gratings, holograms and diffractive optical elements (DOEs).

EXEMPLARY EMBODIMENTS

An embodiment of the invention will now be described with specific reference to FIGS. 1 to 4. FIG. 1 depicts in plan view a cut-out section of relief layer 10, produced in accordance with the invention by embossing and curing a transparent radiation-curable coating applied to a transparent substrate. Relief layer 10 comprises a uniformly repeating array of substantially identical microstructure units, including individual microstructure units 11*a*, 11*b*, 11*c* and 11*d* (only 11*d* is fully contained within the cut-out section of relief layer 10 depicted in FIG. 1). Microstructure units 11*a*-11*d* include three-dimensionally structured formations as recessed grooves in the form of "O"-shapes, and are produced by embossing the coating with a shim having corresponding "O"-shaped embossing elements protruding from the shim surface, and simultaneously curing the coating with UV-light.

Figure 2:
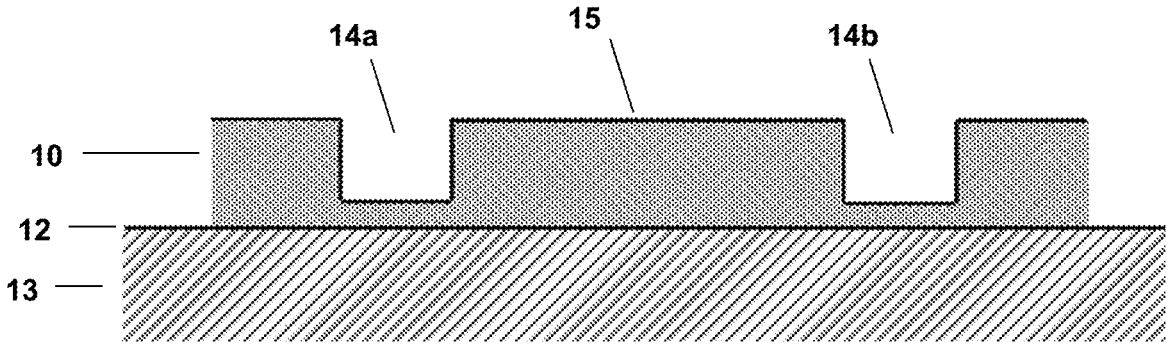
FIG. 2 depicts in side view (not to scale) the relief layer of FIG. 1, taken through section line A-B indicated in FIG. 1.

FIG. 2 depicts in side view (not to scale) relief layer 10, taken through section line A-B as indicated in FIG. 1. Relief layer 10 is on first surface 12 of transparent substrate 13. Grooves 14*a* and 14*b* are formed as recesses in base surface plane 15 of relief layer 10, corresponding to the sections of microstructure unit 11*d* intersected by section line A-B. Grooves 14*a* and 14*b* have a width of approximately 2 microns and a depth of approximately 2 microns.

Figure 3:
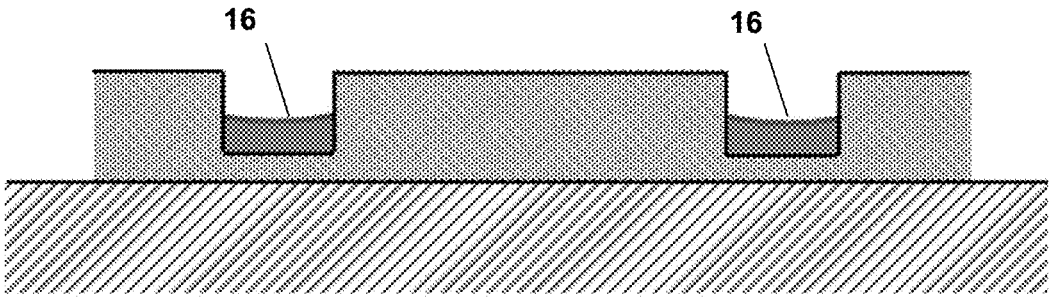
FIG. 3 depicts the relief layer of FIG. 2, after a coloured ink fluid has been applied to and preferentially accumulated on the microstructure units in accordance with an embodiment of the invention.

FIG. 3 depicts relief layer 10, again in side view, after coloured ink fluid 16 has been applied to relief layer 10 in accordance with the invention. Coloured ink fluid 16 has preferentially accumulated by flowing from the surrounding regions of base surface plane 15 into grooves 14*a* and 14*b*. In the embodiment depicted in FIG. 3, coloured ink fluid 16 has a viscosity and has been applied at a loading suitable to cover the base surface of, but not completely fill, grooves 14*a* and 14*b* (and thus the entire recessed "O"-shape groove of microstructure unit 11*d*). As a result of the preferential accumulation of ink fluid 16 into grooves 14*a* and 14*b*, surrounding regions of base surface plane 15 are substantially free of ink.

Figure 4:
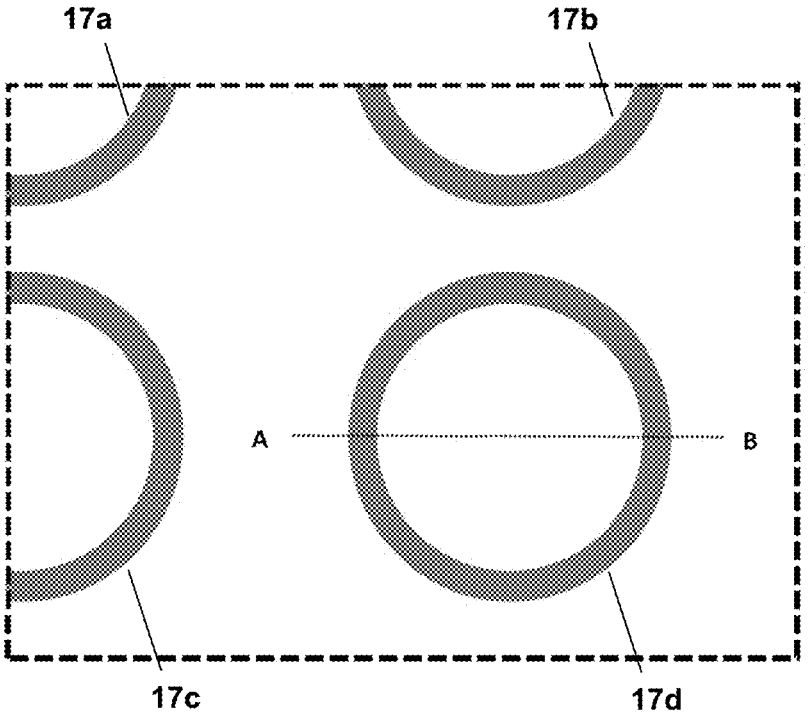
FIG. 4 depicts in plan view the inked relief layer of FIG. 3, on which colour-contrasted micro-image elements have been formed as a result of the preferential accumulation of the ink fluid.

FIG. 4 depicts relief layer 10, once again in plan view, after coloured ink fluid 16 has been applied as depicted in FIG. 3, and after ink fluid 16 has been dried or cured. Colour-contrasted micro-image elements 17*a*, 17*b*, 17*c* and 17*d*, in the form of positive (i.e. ink-filled) "O"-shaped symbols, are provided on the substrate surface as a result of the preferential accumulation of ink fluid 16 to provide areas of high ink density at grooves 14*a* and 14*b* and contrasting areas of low ink density on the surrounding regions of base surface 15.

Another embodiment of the invention will now be described with specific reference to FIGS. 1, 2, 5 and 6. FIGS. 1 and 2 are as described above.

Figure 5:
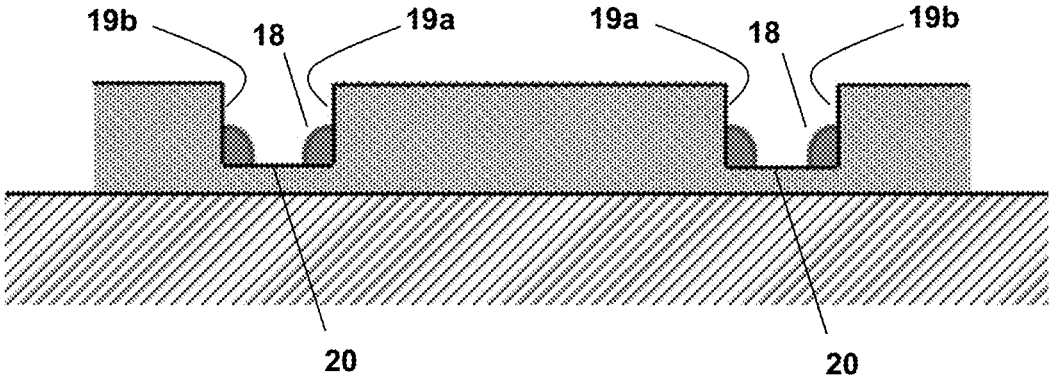
FIG. 5 depicts the relief layer of FIG. 2, after a coloured ink fluid has been applied to and preferentially accumulated on the microstructure units in accordance with another embodiment of the invention.

FIG. 5 depicts relief layer 10, again in side view, after coloured ink fluid 18 has been applied to relief layer 10 in accordance with the invention. In the embodiment depicted in FIG. 5, coloured ink fluid 18 has a viscosity and has been applied at a loading suitable to flow both from the surrounding regions of base surface plane 15 into grooves 14*a* and 14*b*, and within grooves 14*a* and 14*b* against opposing side walls 19*a* and 19*b*. Ink fluid 18 has thus accumulated preferentially at the corner regions (i.e. regions of high surface curvature) of grooves 14*a* and 14*b*, where side walls 19*a* and 19*b* intersect recess base surfaces 20. As a result of the preferential accumulation of ink fluid 18 within grooves 14*a* and 14*b* and against side walls 19*a* and 19*b*, surrounding regions of base surface plane 15 and intermediate portions of recess base surfaces 20 are substantially free of ink.

Figure 6:
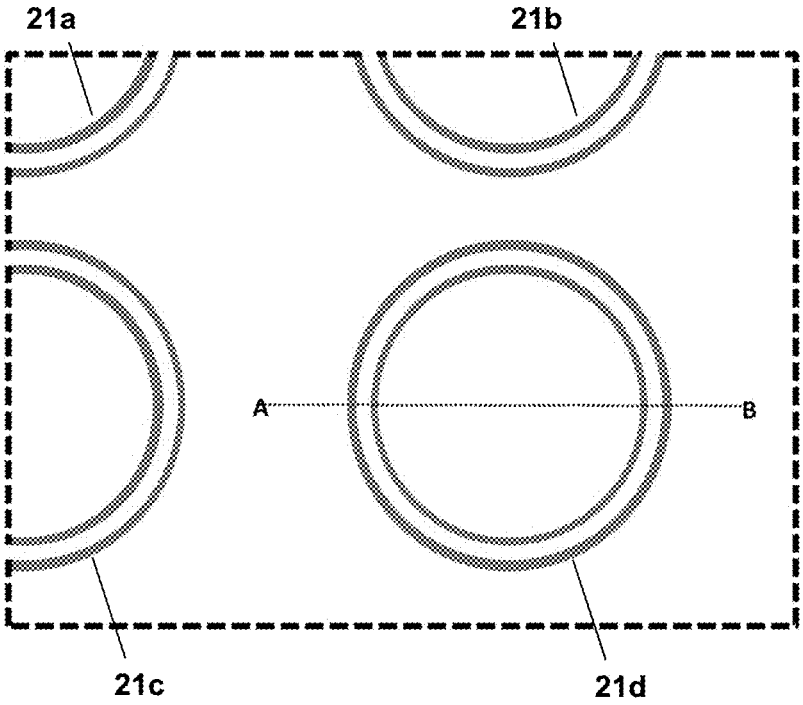
FIG. 6 depicts in plan view the inked relief layer of FIG. 5, on which colour-contrasted micro-image elements have been formed as a result of the preferential accumulation of the ink fluid.

FIG. 6 depicts relief layer 10, once again in plan view, after coloured ink fluid 18 has been applied as depicted in FIG. 5, and after ink fluid 18 has been dried or cured. Colour-contrasted micro-image elements 21*a*, 21*b*, 21*c* and 21*d*, in the form of negative "O"-shaped symbols, are provided on the substrate surface as a result of the preferential accumulation of ink fluid 18. The symbols are provided by the lines of ink fluid 18 (i.e. areas of high ink density) accumulated against the opposing side walls of the grooved recesses of microstructure units 11*a*-11*d*, which outline and provide colour contrast for the negative (i.e. ink-outlined) "O"-shaped micro-image elements 21*a*, 21*b*, 21*c* and 21*d*.

Figure 7:
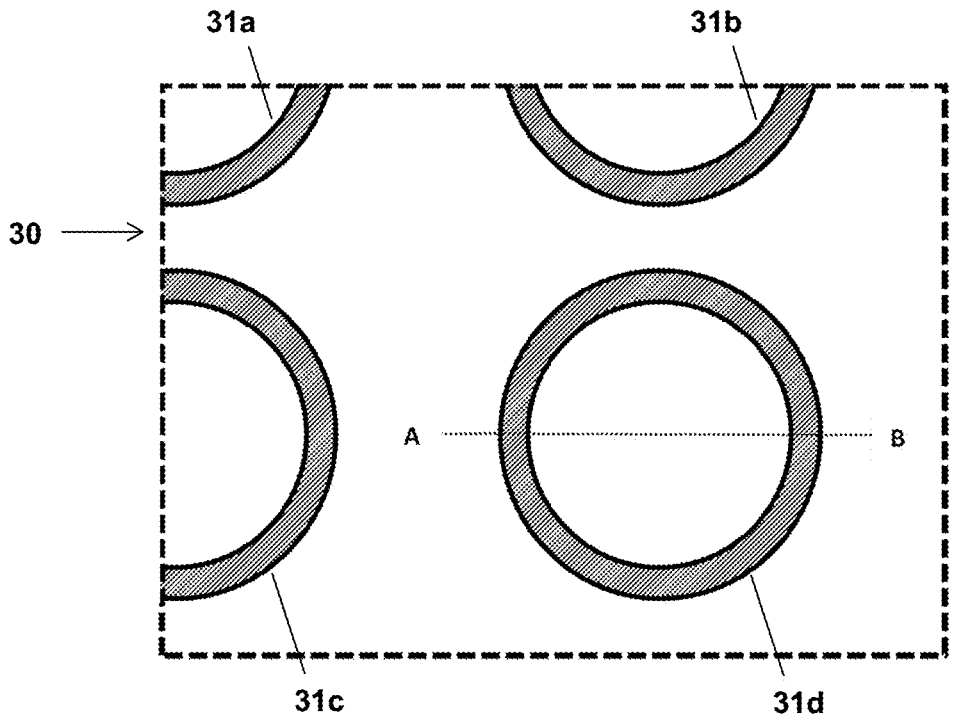
FIG. 7 depicts in plan view a cut-out section of a relief layer with microstructure units comprising protruding three-dimensionally structured formations, produced in accordance with an embodiment of the invention.

Another embodiment of the invention will now be described with specific reference to FIGS. 7 to 10. FIG. 7 depicts in plan view a cut-out section of relief layer 30, produced in accordance with the invention by embossing and curing a transparent radiation-curable coating applied to a transparent substrate. Relief layer 30 comprises a uniformly repeating array of substantially identical microstructure units, including individual microstructure units 31*a*, 31*b*, 31*c* and 31*d* (only 31*d* is fully contained within the cut-out section of relief layer 30 depicted in FIG. 7). Microstructure units 31*a*-31*d* include three-dimensionally structured formations as protruding ridges in the form of "O"-shapes, and are produced by embossing the coating with a shim having corresponding "O"-shaped embossing elements recessed into the shim surface, and simultaneously curing the coating with UV-light.

Figure 8:
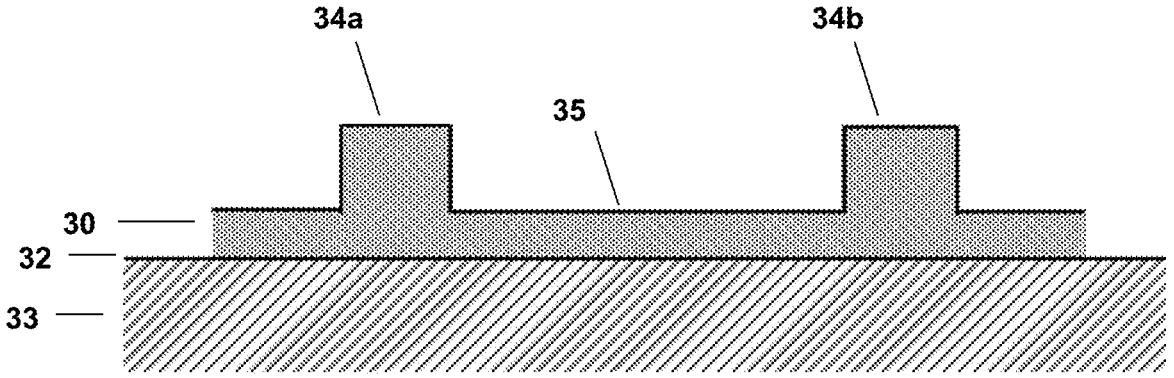
FIG. 8 depicts in side view (not to scale) the relief layer of FIG. 7, taken through section line A-B indicated in FIG. 7.

FIG. 8 depicts in side view (not to scale) relief layer 30, taken through section line A-B as indicated in FIG. 7. Relief layer 30 is on first surface 32 of transparent substrate 33. Ridges 34*a* and 34*b* are formed as protrusions from base surface plane 35 of coating 30, corresponding to the sections of microstructure unit 31*d* intersected by section line A-B. Ridges 34*a* and 34*b* have a width of approximately 2 microns and a height of approximately 2 microns.

Figure 9:
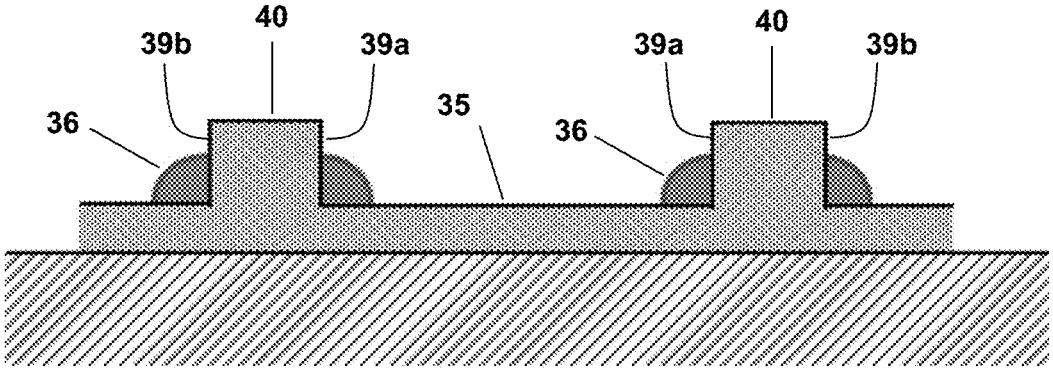
FIG. 9 depicts the relief layer of FIG. 8, after a coloured ink fluid has been applied to and preferentially accumulated on the microstructure units in accordance with another embodiment of the invention.

FIG. 9 depicts relief layer 30, again in side view, after coloured ink fluid 36 has been applied to relief layer 30 in accordance with the invention. In the embodiment depicted in FIG. 9, coloured ink fluid 36 has a viscosity and has been applied at a loading suitable to flow from the surrounding regions of base surface plane 35 and accumulate against both opposing side walls 39*a* and 39*b* of ridges 34*a* and 34*b*. Ink fluid 36 has thus accumulated preferentially at the corners (i.e. regions of high surface curvature) where side walls 39*a* and 39*b* intersect base surface plane 35. As a result of the selective accumulation of ink fluid 36, ridge tops 40, and at least the regions of base surface plane 35 surrounding ridges 34*a* and 34*b*, are substantially free of ink.

Figure 10:
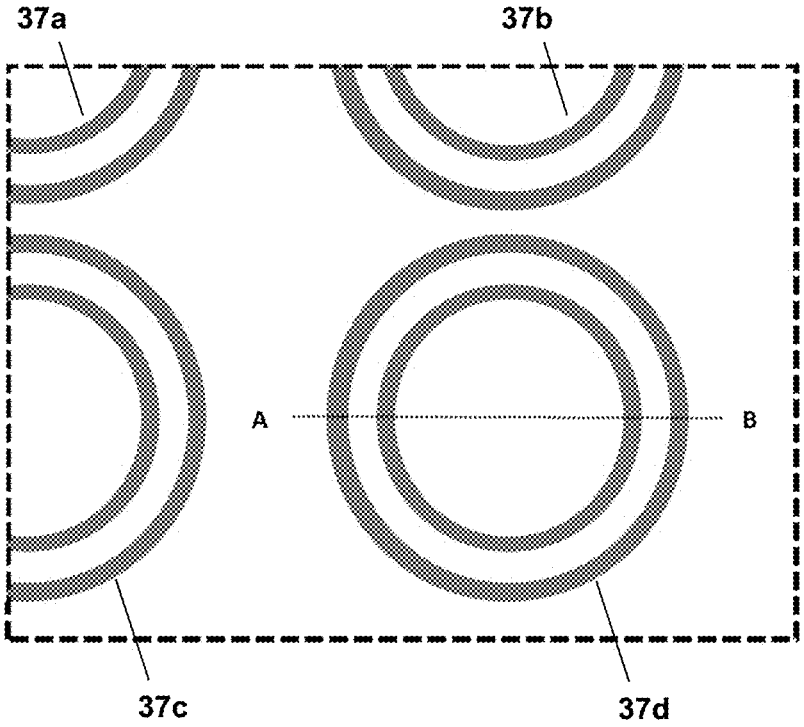
FIG. 10 depicts in plan view the inked relief layer of FIG. 9, on which colour-contrasted micro-image elements have been formed as a result of the preferentially accumulation of the ink fluid.

FIG. 10 depicts relief layer 30, once again in plan view, after coloured ink fluid 36 has been applied as depicted in FIG. 9, and after ink fluid 36 has been dried or cured. Colour-contrasted micro-image elements 37*a*, 37*b*, 37*c* and 37*d*, in the form of negative "O"-shaped symbols, are provided on the substrate surface as a result of the preferential accumulation of ink fluid 36. The symbols are provided by the lines of ink fluid 36 (i.e. areas of high ink density) accumulated against the opposing side walls of the protruding ridges of microstructure units 31*a*-31*d*, which outline and provide colour contrast for the negative (i.e. ink-outlined) "O"-shaped micro-image elements 37*a*, 37*b*, 37*c* and 37*d*.

EXAMPLES

The present invention is described with reference to the following examples. It is to be understood that the examples are illustrative of and not limiting to the invention described herein.

Example 1 (Comparative)

A shim (300 mm×300 mm) was made by spinning a layer of photoresist onto a substrate and then exposing the photoresist with UV light transmitted through a mask, wherein said mask has UV-transparent portions in correspondence to the desired microstructure pattern. The UV-exposed photoresist was then chemically developed, to produce recessed regions in the photoresist surface exposing the underlying substrate. An electroplating seed layer was deposited on the chemically developed photoresist structures and exposed underlying substrate. The seed layer was then electroplated with nickel to form the finished shim. The finished shim was attached to a roller for use as an embossing tool.

A colourless, transparent relief layer comprising three-dimensionally structured microstructure units was produced by applying a layer of transparent UV-curable resin to a 75 micron thick transparent substrate, and then simultaneously embossing and irradiating the coating through the substrate with UV-light.

The embossed relief layer comprised a regular hexagonal array of microstructure units in the form of individual portions of recessed "E"-symbols, extending over the surface of the relief layer in a configuration designed to project an integral image when viewed through micro-lenses. The hexagonal array had a pitch of approximately 53 microns. The embossing depth in the relief layer (i.e. the depths of the embossed grooves, corresponding to the height of the protruding embossing elements on the shim) was approximately 1.8 microns. The width of the grooves forming the "E"-symbols was approximately 2 microns.

A separate transparent sheet (approximately 85 micron thickness), comprising a hexagonal array of embossed hemispherical micro-lenses (53 micron pitch, 51 micron lens width, 10 micron sag height, approximately 115 micron focal length), was then overlaid on the embossed relief layer (i.e. on the same side of the substrate as the relief layer) such that the hexagonal array of microstructure units was aligned to and in direct contact with the hexagonal array of micro-lenses (a droplet of water was applied in between the microstructure units and the lens substrate to ensure direct contact). The embossed microstructure units thus lay close to, but just within, the focal length of the micro-lenses.

When viewed through the micro-lenses in transmitted or reflected light, the embossed relief layer produced a gray-scale integral image of only limited contrast. Furthermore, the ink-free relief layer is susceptible to being filled with liquid contaminants such as sweat from the user, which would cause the contrast to disappear entirely, and the relief layer is susceptible to mechanical copying since the structures are exposed.

Example 2

The embossed relief layer of Example 1 was then overprinted with a silver ink (solvent based, solids content of 30% by volume, application via RK Coater meter bar no. 0). After the ink was dried, yielding a dry loading of 0.2 g/m$^2$, the sheet of micro-lenses was again overlaid on the relief layer, as in Example 1.

When viewed through the micro-lenses in transmitted light, an integral image of a magnified "E"-symbol was clearly visible, with excellent contrast. The "E" symbol was approximately 1 cm×1 cm in size, and appeared to float approximately 1 cm above the plane of the micro-lenses. It was evident from the integral image that the ink had accumulated in a substantially uniform distribution on each of the microstructure units, flowing from the immediately surrounding regions of the "E"-shaped microstructure units (which were visibly ink-depleted in the integrated image compared to more distant regions in the base surface plane of the relief layer) into the recessed grooves of the microstructure units. The contrast between the ink-filled recesses and the ink-depleted surrounding areas in each of the micro-image elements (as schematically depicted in FIGS. 3 and 4) thus contributed to the projection of a colour-contrasted integral image.

Example 3

Another colourless, transparent relief layer comprising microstructure units was produced according to the method of Example 1. In this case, the embossed relief layer comprised an array of microstructure units in the form of "O"-shaped protruding ridges proud on the surface of the relief layer. The embossing height in the relief layer (i.e. the protrusion heights of the embossed features, corresponding to the depth of the recessed embossing elements on the shim) was approximately 1.8 microns. The width of the ridges forming the "O"-shapes was approximately 2 microns.

The embossed relief layer was then overprinted with a silver ink (solvent based, solids content of 30 by volume %, application via RK Coater meter bar no. 0. After the ink was dried in an oven, yielding a dry loading of 0.2 g/m$^2$, the sheet of micro-lenses was again overlaid on the relief layer, as in Example 1.

When viewed through the micro-lenses in transmitted light, a magnified moiré image of a pattern of "O"-shapes was clearly visible, with excellent contrast. It was evident from the moiré image that the ink had preferentially accumulated on the surface of the relief structure against the side walls of the protruding ridges. The contrast between the ink accumulated adjacent to the microstructure side walls and the ink-free (or at least ink-depleted) ridges in each of the micro-image elements (as schematically depicted in FIGS. 9 and 10) thus contributed to the projection of a colour-contrasted magnified moiré image.

Example 4

Another colourless, transparent relief layer comprising microstructure units was produced according to the method of Example 1. In this case, the microstructure units were hexagonally packed unit cells of a repeating hexagon pattern, extending over the surface of the relief layer. The fine lines of the hexagon pattern were recessed grooves embossed into surrounding regions of the relief layer. The hexagonal pattern had a pitch of approximately 53 microns. The embossing depth in the relief layer was approximately 1.7-1.8 microns. The minimum width of the grooves forming the pattern was approximately 1-2 microns.

The embossed relief layer was then overprinted with a black ink (solvent based, solids content of 20% by volume, viscosity of 19 seconds as measured with a Zahn cup #2; application via RK Coater meter bar no. 0) at a wet loading of 4 g/m$^2$. After the ink was dry, the sheet of micro-lenses was again overlaid on the relief layer, as in Example 1.

When viewed through the micro-lenses in transmitted light, a magnified moiré image of a hexagon pattern was clearly visible, with excellent contrast. It was evident from the moiré image that the ink had preferentially accumulated on the surface of the relief structure, at least partially filling the recessed grooves of the hexagon pattern microstructures. The contrast between the ink-filled recesses and the ink-free (or at least ink-depleted) surrounding areas in each of the micro-image elements (as schematically depicted in FIGS. 3 and 4) thus contributed to the projection of a colour-contrasted magnified moiré image.

Those skilled in the art will appreciate that the invention described herein is susceptible to variations and modifications other than those specifically described. It is understood that the invention includes all such variations and modifications which fall within the spirit and scope of the present invention.

Future patent applications may be filed in Australia or overseas on the basis of or claiming priority from the present application. It is to be understood that the following provisional claims are provided by way of example only, and are not intended to limit the scope of what may be claimed in any such future application. Features may be added to or omitted from the provisional claims at a later date so as to further define or re-define the invention or inventions.

What is claimed is:

1. A method of producing micro-image elements on a substrate of a security document, the method comprising:

producing a plurality of microstructure units comprising three-dimensionally structured formations in a clear or pale relief layer on the substrate of the security document, wherein the microstructure units comprise at least one formation side wall that intersects with a surrounding surface region of the security document; and applying a coloured ink fluid to the relief layer, wherein the coloured ink fluid preferentially accumulates at an intersection of the at least one formation side wall and the surrounding surface region to provide contrasting areas of different ink density on the security document, wherein the contrasting areas of different ink density comprise an area of a first ink density adjacent to the at least one formation side wall and a contrasting area of a second ink density lower than the first ink density on the surrounding surface region, and wherein the surrounding surface region is substantially parallel to a plane of the substrate, whereby the security document is produced and the security document comprises a micro-optic device comprising the plurality of microstructure units and coloured ink that has preferentially accumulated at the intersection of the formation side wall and the surrounding surface region of the security document.

2. The method of claim 1, wherein a repeating array of substantially identical microstructure units is produced in the relief layer, and wherein the coloured ink fluid accumulates in a substantially uniform distribution on each substantially identical microstructure unit.

3. The method of claim 1, wherein the plurality of microstructure units is produced by embossing the three-dimensionally structured formations into the relief layer.

4. The method of claim 1, wherein the plurality of microstructure units is produced by:

filling a plurality of recesses in a surface of a printing tool with a clear or pale lacquer; and transferring the lacquer from the recesses to the substrate by contacting the surface of the printing tool with the substrate.

5. The method of claim 1, wherein the microstructure units comprise at least one recess recessed into surrounding regions of the relief layer, the recess having side walls and a recess base surface between the side walls.

6. The method of claim 5, wherein the coloured ink fluid accumulates within the recess by flowing from the surrounding regions into the recess.

7. The method of claim 5, wherein the coloured ink fluid accumulates preferentially within the recess and covers the recess base surface.

8. The method of claim 7, wherein the coloured ink fluid does not fill the recess.

9. The method of claim 5, wherein the coloured ink fluid accumulates preferentially within the recess at an intersection of the side walls and the recess base surface, wherein the contrasting areas of different ink density comprise areas of high ink density adjacent to the side walls and a contrasting area of low ink density on the recess base surface intermediate the side walls.

10. The method of claim 1, wherein the microstructure units comprise at least one protrusion protruding from surrounding regions of the relief layer, the protrusion having side walls.

11. The method of claim 10, wherein the coloured ink fluid accumulates at the intersection of the side walls and the surrounding regions of the relief layer.

12. The method of claim 1, wherein micro-image elements comprising ink accumulated at the intersection of the side wall and the surrounding regions of the relief layer produce a visible optical effect when viewed through an array of focusing elements disposed on the substrate.

13. The method of claim 1, further comprising applying a contrast coating over the relief layer after applying the coloured ink fluid, wherein the contrast coating has a different colour to the coloured ink fluid such that micro-image elements comprising ink accumulated at the intersection of the side wall and the surrounding surface region are contrasted against the contrast coating when viewed in reflected light through the substrate.

14. The method of claim 1, wherein the coloured ink fluid has a viscosity 10 to 50 centipoise.

15. The method of claim 1, wherein the coloured ink fluid has a viscosity 10 to 20 centipoise.

* * * * *